US008733033B2

(12) United States Patent
Schwartau

(10) Patent No.: US 8,733,033 B2
(45) Date of Patent: May 27, 2014

(54) SANDWICH PANEL GROUND ANCHOR AND GROUND PREPARATION FOR SANDWICH PANEL STRUCTURES

(75) Inventor: Ulrich Schwartau, Port d Andratx (ES)

(73) Assignee: Millport Associates, SA, Panama (PA)

( * ) Notice: Subject to any disclaimer, the term of this patent is extended or adjusted under 35 U.S.C. 154(b) by 509 days.

(21) Appl. No.: 12/147,795

(22) Filed: Jun. 27, 2008

(65) Prior Publication Data

US 2009/0320387 A1 Dec. 31, 2009

(51) Int. Cl.
*E04B 1/00* (2006.01)

(52) U.S. Cl.
USPC ..... 52/169.11

(58) Field of Classification Search
CPC ..... E04C 2/365; E04C 2/36; E04C 2/34; E04B 1/12; E04B 1/14; E04B 1/612
USPC ..... 52/169.11, 293.3, 290, 283, 284, 745.1, 52/309.9, 293.1
See application file for complete search history.

(56) References Cited

U.S. PATENT DOCUMENTS

| | | | | |
|---|---|---|---|---|
| 183,160 | A | | 10/1876 | Haughian et al. |
| 1,377,891 | A | | 5/1921 | Knight et al. |
| 1,664,867 | A | | 4/1928 | Strand |
| 1,671,084 | A | | 5/1928 | Meyercord |
| 2,120,200 | A | | 6/1938 | Davis |
| 2,142,771 | A | | 1/1939 | Alexander |
| 2,181,164 | A | | 11/1939 | Alexander |
| 2,230,628 | A | | 2/1941 | Sahlberg et al. |
| 2,255,151 | A | | 9/1941 | Clements |
| 3,079,649 | A | | 3/1963 | Willatts |
| 3,082,726 | A | | 3/1963 | Dosker |
| 3,112,043 | A | | 11/1963 | Tucker |
| 3,117,902 | A | | 1/1964 | Holzheimer |
| 3,170,269 | A | * | 2/1965 | Dunnington ..... 52/293.3 |
| 3,256,666 | A | | 6/1966 | Farmer |
| 3,301,732 | A | | 1/1967 | Kunz |

(Continued)

FOREIGN PATENT DOCUMENTS

| | | | |
|---|---|---|---|
| DE | 1609457 | A1 | 7/1970 |
| DE | 29 14 576 | A1 | 10/1979 |

(Continued)

OTHER PUBLICATIONS

International Search Report Corresponding to PCT/EP2007/002591, mailed Jun. 22, 2007.

(Continued)

*Primary Examiner* — Mark Wendell
(74) *Attorney, Agent, or Firm* — Renner, Otto, Boisselle & Sklar LLP

(57) ABSTRACT

A ground anchor and method for anchoring a building to the ground. The ground anchor has a base member having a core and an outer layer connected to the core. The ground anchor also has a support member having two outer layers separated from one another by a core, the support member having a top surface and a bottom surface. A bonding material connects the bottom surface of the support member to the outer surface of the base member. Bonding material also connects the top surface of the support member to a building element. The ground anchor is buried in the ground at the construction site and connected to the building to anchor the building to the ground.

24 Claims, 4 Drawing Sheets

(56) References Cited

U.S. PATENT DOCUMENTS 3,388,514 A * 6/1968 Archinal et al. ..... 52/97
3,425,889 A 2/1969 Willits, Jr.
3,436,881 A 4/1969 Schlecht
3,440,790 A 4/1969 Nerem
3,462,897 A 8/1969 Weinrott
3,562,973 A 2/1971 Gangemi
3,590,540 A 7/1971 Johnson et al.
3,646,720 A 3/1972 Watts
3,708,385 A 1/1973 Immethun
3,791,910 A 2/1974 Bowser
3,866,381 A 2/1975 Eschbach et al.
3,909,995 A 10/1975 Bainter et al.
3,911,554 A 10/1975 Ford
3,949,532 A 4/1976 Jonsson et al.
3,969,868 A 7/1976 Bainter et al.
4,021,982 A 5/1977 Kotcharian
4,024,684 A 5/1977 Holmgren
4,050,609 A 9/1977 Okamoto et al.
4,074,489 A 2/1978 Eckel
4,074,498 A 2/1978 Keller et al.
4,176,504 A * 12/1979 Huggins ..... 52/61
4,177,306 A 12/1979 Schulz et al.
4,199,909 A 4/1980 Kotcharian
4,336,090 A 6/1982 Hilton
4,373,304 A 2/1983 Howitt
4,402,170 A 9/1983 Seidner
4,435,928 A 3/1984 Huling, III
4,696,137 A 9/1987 Schleich
4,704,837 A 11/1987 Menchetti et al.
4,852,310 A 8/1989 Henley et al.
4,917,747 A 4/1990 Chin et al.
4,936,069 A 6/1990 Hunter et al.
5,100,713 A 3/1992 Homma et al.
5,129,628 A 7/1992 Vesper
5,274,974 A 1/1994 Haag
5,277,002 A 1/1994 Haag
5,285,616 A 2/1994 Tripp
5,310,594 A 5/1994 Holland et al.
5,349,796 A 9/1994 Meyerson
5,509,242 A 4/1996 Rechsteiner et al.
5,535,556 A 7/1996 Hughes, Jr.
5,557,904 A 9/1996 Dahowski
5,625,996 A 5/1997 Bechtel
5,652,039 A 7/1997 Tremain et al.
5,653,080 A 8/1997 Bergeron
5,743,056 A * 4/1998 Balla-Goddard et al. . 52/309.11
5,771,549 A 6/1998 Saaf
5,824,382 A 10/1998 Ruby
5,826,396 A 10/1998 Michaels
5,834,082 A 11/1998 Day
5,966,894 A 10/1999 Crump, Jr.
5,974,760 A 11/1999 Tingley
6,050,208 A 4/2000 Kennedy
6,065,259 A * 5/2000 Clear ..... 52/284
6,085,469 A 7/2000 Wolfe
6,125,602 A 10/2000 Freiborg et al.
6,158,183 A 12/2000 Snell
6,176,637 B1 1/2001 Hatlan et al.
6,253,530 B1 * 7/2001 Price et al. ..... 52/793.1
6,256,960 B1 * 7/2001 Babcock et al. ..... 52/592.1
6,279,287 B1 * 8/2001 Meadows ..... 52/589.1
6,295,786 B1 10/2001 Lee
6,298,619 B1 * 10/2001 Davie ..... 52/293.3
6,305,142 B1 10/2001 Brisson et al.
6,412,247 B1 7/2002 Menchetti et al.
6,446,412 B2 9/2002 Mathis
6,565,942 B2 5/2003 Anderson et al.
6,584,740 B2 * 7/2003 Record ..... 52/270
6,591,557 B1 7/2003 Thomsen et al.
6,604,328 B1 8/2003 Paddock
6,619,007 B1 9/2003 Riesmeier
6,627,018 B1 9/2003 O'Neill et al.
6,672,014 B1 1/2004 Jones
6,706,406 B1 3/2004 Kennedy
6,758,017 B2 7/2004 Young
6,941,720 B2 9/2005 DeFord et al.
6,948,287 B2 9/2005 Korn
7,021,014 B1 4/2006 Wolfe
7,056,567 B2 6/2006 O'Neill et al.
7,062,885 B1 6/2006 Dickenson, Jr.
7,127,865 B2 * 10/2006 Douglas ..... 52/745.13
7,225,596 B2 6/2007 Wrass
7,238,409 B1 7/2007 Peterson et al.
7,371,304 B2 * 5/2008 Christman et al. ..... 156/293
7,448,172 B1 11/2008 Knodel
7,509,776 B2 3/2009 Reisman
7,581,366 B2 9/2009 Smith et al.
7,779,600 B1 8/2010 Saebi
7,836,641 B2 11/2010 Back et al.
7,997,037 B2 8/2011 Crandell et al.
7,997,044 B2 8/2011 Green et al.
8,016,230 B2 * 9/2011 Fogarty et al. ..... 244/117 R
8,061,105 B2 11/2011 Haga
8,065,841 B2 11/2011 Antonic
8,142,879 B2 3/2012 Whitaker et al.
8,291,655 B2 10/2012 McGlothlin
8,470,425 B2 6/2013 Day et al.
8,474,197 B2 7/2013 Bennett et al.
8,511,043 B2 8/2013 Fyfe
2002/0038687 A1 4/2002 Anderson et al.
2002/0069600 A1 * 6/2002 Bryant ..... 52/309.9
2002/0108342 A1 8/2002 Henits
2002/0139059 A1 10/2002 Zimmerman
2002/0144482 A1 10/2002 Henson et al.
2002/0176749 A1 * 11/2002 Provost ..... 405/230
2002/0182955 A1 12/2002 Weglewski et al.
2003/0003258 A1 1/2003 Durso et al.
2003/0087572 A1 5/2003 Balthes et al.
2003/0089061 A1 5/2003 DeFord et al.
2003/0145550 A1 8/2003 Bennett et al.
2003/0182886 A1 * 10/2003 Parrish ..... 52/293.3
2004/0040234 A1 3/2004 Davison et al.
2004/0103601 A1 * 6/2004 Bergqvist ..... 52/284
2004/0144040 A1 7/2004 Fulford et al.
2004/0211144 A1 10/2004 Stanchfield
2005/0064128 A1 3/2005 Lane et al.
2005/0126699 A1 6/2005 Yen et al.
2005/0138891 A1 6/2005 Wool et al.
2005/0167027 A1 8/2005 Lane
2005/0229504 A1 10/2005 Bennett et al.
2006/0096205 A1 5/2006 Griffin et al.
2006/0185305 A1 8/2006 Schaffer
2006/0225836 A1 10/2006 LeFevre et al.
2007/0022707 A1 2/2007 Gregg et al.
2007/0025588 A1 2/2007 Bachmann et al.
2007/0125042 A1 6/2007 Hughes et al.
2008/0041013 A1 2/2008 Vetesnik et al.
2008/0124576 A1 5/2008 Elliott
2008/0236058 A1 10/2008 Antonie
2009/0004423 A1 1/2009 Dietz
2009/0255204 A1 10/2009 Schwartau
2009/0255213 A1 10/2009 Schwartau
2009/0282777 A1 11/2009 Schwartau
2009/0293396 A1 * 12/2009 Porter ..... 52/309.3
2009/0307995 A1 12/2009 Schwartau
2009/0313926 A1 12/2009 Schwartau
2009/0320387 A1 12/2009 Schwartau
2010/0005732 A1 1/2010 Schwartau
2010/0050542 A1 3/2010 Schwartau
2010/0050549 A1 3/2010 Schwartau
2010/0050553 A1 3/2010 Schofield

FOREIGN PATENT DOCUMENTS

DE 39 01 237 A1 7/1990
DE 197 15 529 C1 8/1998
DE 103 02 869 B3 6/2004
DE 10 2005 054 6 3/2007
DE 20 2006 004 153 U1 8/2007
DE 10 2006 018 110 A1 9/2007
DE 20 2006 004 646 U1 9/2007
DE 20 2006 004 985 U1 9/2007
EP 0105411 A 4/1984
EP 0 249 592 A2 12/1987

(56) References Cited

FOREIGN PATENT DOCUMENTS

| | | | |
|---|---|---|---|
| EP | 0438766 | A | 7/1991 |
| EP | 0478033 | A | 4/1992 |
| EP | 0 843 054 | A2 | 5/1998 |
| EP | 1 393 892 | A | 3/2004 |
| FR | 2 154 655 | A | 5/1973 |
| FR | 2 831 229 | A1 | 4/2003 |
| GB | 559 527 | A | 2/1944 |
| GB | 1375877 | A | 11/1974 |
| GB | 2225 282 | A | 5/1990 |
| GB | 2 399 539 | A | 9/2004 |
| SE | 461076 | B | 1/1990 |
| WO | WO 84/04727 | A | 12/1984 |
| WO | 85/02895 | A1 | 7/1985 |
| WO | 01/19603 | A1 | 3/2001 |
| WO | 01/59311 | A1 | 8/2001 |
| WO | 02/04876 | A1 | 5/2002 |
| WO | 02/40876 | A1 | 5/2002 |
| WO | WO 2007/104577 | A1 | 9/2007 |
| WO | WO 2007/107376 | A1 | 9/2007 |
| WO | WO 2007/110223 | A1 | 10/2007 |
| WO | WO 2007/121899 | A1 | 11/2007 |
| WO | 2009/125289 | A2 | 10/2009 |
| WO | 2009/125291 | A2 | 9/2010 |

OTHER PUBLICATIONS

International Search Report Corresponding to PCT/EP2007/002684, mailed Aug. 7, 2007.
International Search Report Corresponding to PCT/EP2007/003379, mailed Jul. 24, 2007.
Ulrich Schwartau, Straight Joint for Sandwich Panels and Method of Fabricating Same, U.S. Appl. No. 12/101,620, filed Apr. 11, 2008.
Ulrich Schwartau, Straight Panel With Closed Edge and Methods of Fabricating, U.S. Appl. No. 12/101,646, filed Apr. 11, 2008.
Ulrich Schwartau, Angle Joint for Sandwich Panels and Method of Fabricating Same, U.S. Appl. No. 12/119,671, filed May 13, 2008.
Ulrich Schwartau, Roof Construction Joints Made of Sandwich Panels, U.S. Appl. No. 12/138,572, filed Jun. 13, 2008.
Ulrich Schwartau, Connection for Sandwich Panel and Foundation, U.S. Appl. No. 12/142,865, filed Jun. 20, 2008.
Ulrich Schwartau, Joint of Parallel Sandwich Panels, U.S. Appl. No. 12/201,285, filed Aug. 29, 2008.
Ulrich Schwartau, System and Method of Forming At Least a Portion of a Reinforced Roof Structure From Sandwich Panels, U.S. Appl. No. 12/204,576, filed Sep. 4, 2008.
Ulrich Schwartau, Building Roof Structure Having a Round Corner, U.S. Appl. No. 12/170,720, filed Jul. 10, 2008.
Ulrich Schwartau, A Sandwich Panel Joint and Method of Joining Sandwich Panels, U.S. Appl. No. 12/201,687, filed Aug. 29, 2008.
International Search Report corresponding to PCT/EP2007/002350, mailed Jul. 13, 2007.
International Search Report and Written Opinion corresponding to PCT/IB2009/005223, mailed Feb. 9, 2010.
International Preliminary Report on Patentability corresponding to PCT/IB2009/005223, mailed Feb. 9, 2010.
International Search Report and Written Opinion corresponding to PCT/IB2009/005230, mailed Jul. 27, 2010.
International Preliminary Report on Patentability corresponding to PCT/IB2009/005230, mailed Jul. 27, 2010.
Ulrich Schwartau, "Multiple Panel Beams and Methods", U.S. Appl. No. 13/804,471, filed Mar. 14, 2013.
Ulrich Schwartau, "Multiple Panel Column and Methods", U.S. Appl. No. 13/804,777, filed Mar. 14, 2013.
Ulrich Schwartau, "Composite Sandwich Panels and Method of Forming Round Corners in Composite Sandwich Panels", U.S. Appl. No. 13/804,834, filed Mar. 14, 2013.
Ulrich Schwartau, "Columnar Structural Component and Method of Forming", U.S. Appl. No. 13/804,904, filed Mar. 14, 2013.
Ulrich Schwartau, "Columnar Structural Component and Method of Forming", U.S. Appl. No. 13/804,628, filed Mar. 14, 2013.
Ulrich Schwartau, "Ceiling Support Construction and Methods", U.S. Appl. No. 13/804,964, filed Mar. 14, 2013.
Ulrich Schwartau, "Nozzle System and Method for Manufacturing Composite Sandwich Panels", U.S. Appl. No. 13/826,025, filed Mar. 14, 2013.
Ulrich Schwartau, "System and Method for Using an Acetone Solvent to Clean Manufacturing Equipment Used to Manufacture Composite Sandwich Panels", U.S. Appl. No. 13/826,094, filed Mar. 14, 2013.
Ulrich Schwartau, "Apparatus and Method for Producing a Multi-Axis Laminate", U.S. Appl. No. 13/826,169, filed Mar. 14, 2013.

* cited by examiner

FIG. 1
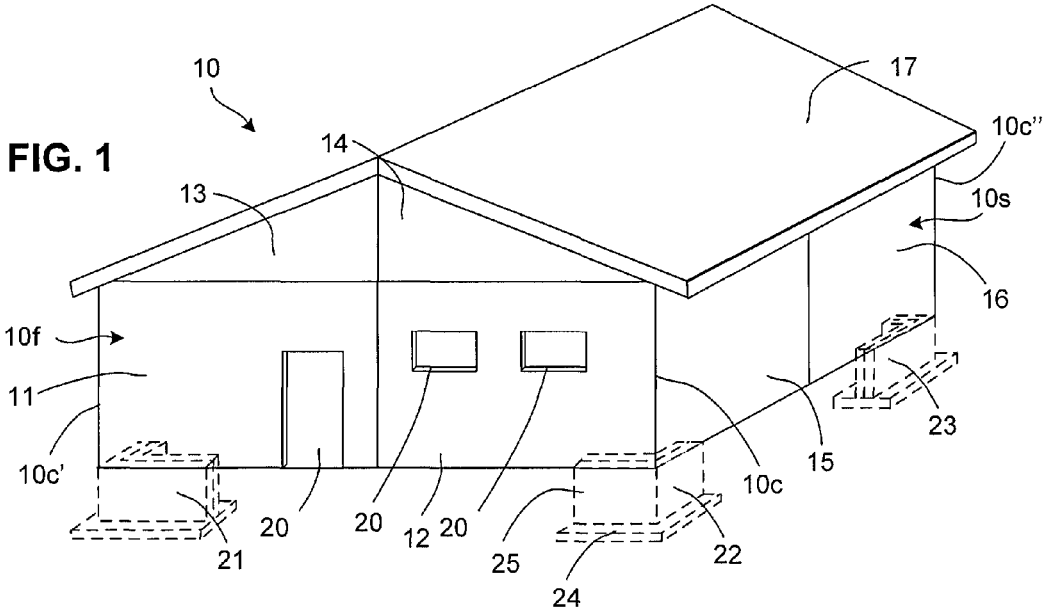
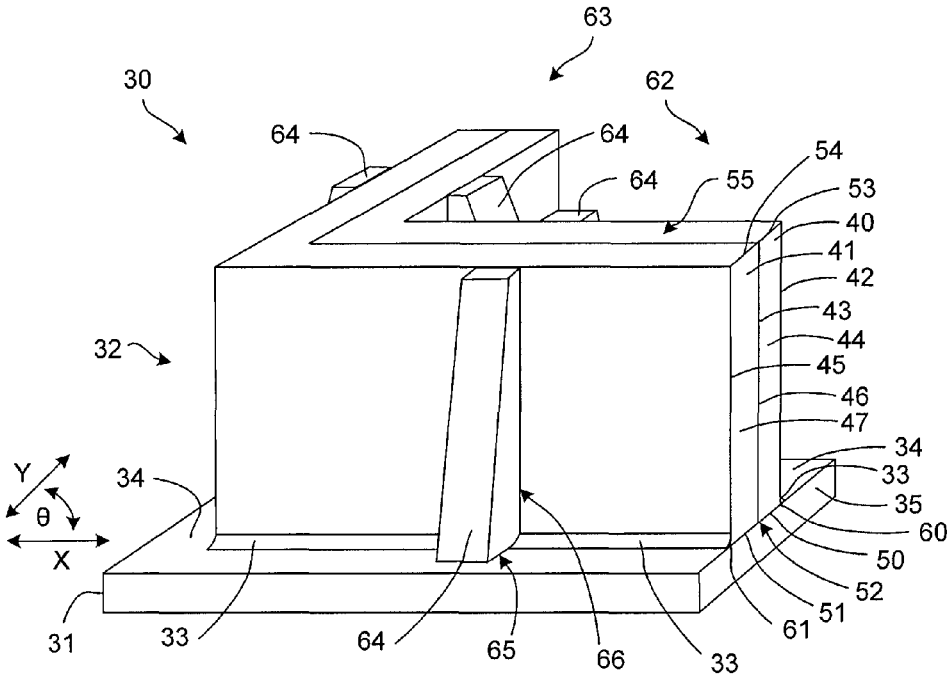
FIG. 2

SANDWICH PANEL GROUND ANCHOR AND GROUND PREPARATION FOR SANDWICH PANEL STRUCTURES

TECHNICAL FIELD OF THE INVENTION

The present invention relates generally to constructing buildings, and more particularly, to a ground anchor constructed from composite sandwich panels for anchoring the building to the ground.

DESCRIPTION OF THE RELATED ART

There is an increasing global demand for lower cost buildings such as houses, warehouses and office space. The demand for lower cost buildings is particularly strong in developing countries where economic resources may be limited and natural resources and raw materials may be scarce. For example, in areas of the Middle East or Africa, conventional building materials such as cement, brick, wood or steel may not be readily available or, if available, may be very expensive. In other areas of the world, poverty may make it too costly for people to build houses or other buildings with conventional materials.

The demand for lower cost housing also is high in areas afflicted by war or natural disasters, such as hurricanes, tornadoes, floods, and the like. These devastating events often lead to widespread destruction of large numbers of buildings and houses, especially when they occur in densely populated regions. The rebuilding of areas affected by these events can cause substantial strain on the supply chain for raw materials, making them difficult or even impossible to obtain. Furthermore, natural disasters often recur and affect the same areas. If a destroyed building is rebuilt using the same conventional materials, it stands to reason that the building may be destroyed or damaged again during a similar event.

It is generally desirable to increase speed of construction and to minimize construction costs. Prefabricated or preassembled components can streamline production and reduce both the time and the cost of building construction. Prefabricated buildings, however, are made from conventional materials that may be scarce or expensive to obtain. Thus, there exists a need for alternative materials and techniques for constructing buildings that use advanced material technologies to increase the speed of construction and to reduce or to lower ownership costs.

SUMMARY

The present invention provides an alternative to conventional construction materials and techniques. Buildings, such as houses, commercial buildings, warehouses, or other structures can be constructed by composite sandwich panels (also referred to as "sandwich panels"), which have an insulative core and one or more outer layers. The buildings can be constructed by gluing several sandwich panels together, and usually traditional fasteners, such as screws, rivets, nails, etc., are not needed for such connections. Generally, composite sandwich panels offer a greater strength-to-weight ratio than traditional materials that are used by the building industry. The composite sandwich panels are generally as strong as, or stronger than, traditional materials including wood-based and steel-based structural insulation panels, while being lighter in weight. Because they weigh less than traditional building materials, the handling and transport of composite sandwich panels is generally less expensive. The composite sandwich panels also can be used to produce light-weight buildings, such as floating houses or other light-weight structures.

Sandwich panels generally are more elastic or flexible than conventional materials such as wood, concrete, steel or brick and, therefore, monolithic (e.g., unitary or single unit structure) buildings made from sandwich panels are more durable than buildings made from conventional materials. For example, sandwich panels also may be non-flammable, waterproof, very strong and durable, and in some cases able to resist hurricane-force winds (up to 300 Kph (kilometers per hour) or more). The sandwich panels also may be resistant to the detrimental effects of algae, fungicides, water, and osmosis. As a result, buildings constructed from sandwich panels may be better able to withstand earthquakes, floods, tornadoes, hurricanes, fires and other natural disasters than buildings constructed from conventional materials.

A number of construction elements, e.g., one or more composite sandwich panels can be connected together, for example, to form an anchor or building foundation member, to erect walls, to build ceilings or roofs, or to divide the interior of the building into one or more rooms, etc. As described in more detail below, the sandwich panels can be glued or otherwise connected to one another with bonding material to form the building foundation member or ground anchor for the building. Several or more anchors may be embedded or buried in the ground and connected to the building, for example, at the corners of the building. A number of ground anchors also may be connected to a center portion or middle portion of the house. The ground anchors secure or affix the building to the ground to increase the stability and/or rigidity of the building.

According to one aspect of the invention, a ground anchor including a base member having a core and an outer layer connected to the core, a support member including at least one sandwich panel having two outer layers separated from one another by a core, the support member having a top surface and a bottom surface, and bonding material connecting the bottom surface of the support member to the outer surface of the base member.

According to another aspect of the ground anchor, the ground anchor further includes bonding material connecting the top surface of the support member to a building element.

According to another aspect of the ground anchor, the base member and the support member extend in a first direction along a first axis and extend in a second direction along a second axis.

According to another aspect of the ground anchor, the first direction corresponds to a portion of a first wall of a building, and the second direction corresponds to a portion of a second wall of the building.

According to another aspect of the ground anchor, the support member includes at least one additional sandwich panel having two outer layers separated from one another by a core and wherein the first sandwich panel and the additional sandwich panel are connected to one another.

According to another aspect of the ground anchor, the ground anchor further includes at least one rib having a bottom surface connected to the outer layer of the base member and a side surface connected to one of the outer layers of one of the sandwich panels of the support member.

According to another aspect of the ground anchor, the base member is generally horizontal and the support member is generally vertical.

According to another aspect of the ground anchor, the connection between the support member and the building member is further comprised a U-profile bracket.

According to another aspect of the ground anchor, top surface of the support member includes bonding material at an edge of the sandwich panel where a portion of the core has been removed.

According to another aspect of the ground anchor, the support member includes at least one additional sandwich panel having two outer layers separated from one another by a core and wherein the first sandwich panel and the additional sandwich panel are connected to one another.

According to another aspect of the ground anchor, the base member is a composite sandwich panel.

According to another aspect of the invention, a building foundation member usable to anchor a building to the ground, the building foundation member including a ground anchor including a base member having a core and an outer layer connected to the core, a support member including at least one sandwich panel having a core and two outer layers separated from one another by the core, and further including a top surface and a bottom surface, and a building element comprised of a sandwich panel, wherein the building element is connected to the top surface of the support member with bonding material, and the outer layer of the base member is connected to the bottom surface of the support member by bonding material, and wherein the ground anchor is at least partially submerged in the ground.

According to another aspect of the building foundation member, the base member and the support member extend in a first direction along a first axis and extend in a second direction along a second axis.

According to another aspect of the building foundation member, first direction corresponds to a portion of a first wall of a building, and the second direction corresponds to a portion of a second wall of the building.

According to another aspect of the building foundation member, the ground anchor further comprises a rib connected to the outer layer of the base member and one of the outer layers of the sandwich panel of the support member.

According to another aspect of the building foundation member, the base member and the support member are generally perpendicular to one another.

According to another aspect of the building foundation member, the ground anchor is connected to a corner of the building.

According to another aspect of the building foundation member, the building foundation member includes a number of ground anchors connected to different corners of the building.

According to another aspect of the building foundation member, the building element is at least one of a floor panel or a wall.

According to another aspect of the building foundation member, the support member and the building element are connected by a U-profile bracket.

According to another aspect of the building foundation member, the top surface of the support member further comprises bonding material at an edge of the sandwich panel where a portion of the core has been removed.

According to another aspect of the invention, a method of anchoring a building to the ground with a ground anchor including excavating a portion of the ground to form a hole, placing the ground anchor into the hole, wherein the ground anchor is comprised of a generally horizontal sandwich panel and a generally vertical support sandwich panel connected to the base sandwich panel with a bonding material, filling the hole with a filler material, compacting a portion of the filler material in the hole, and connecting the support sandwich panel to a portion of the building by applying bonding material between the support sandwich panel and the building element.

According to another aspect of the method, the connecting step further comprises connecting the ground anchor to at least one of a wall, a floor panel or a corner of the building.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto.

It should be emphasized that the term "comprises/comprising" when used in this specification is taken to specify the presence of stated features, integers, steps or components but does not preclude the presence or addition of one or more other features, integers, steps, components or groups thereof.

Features that are described and/or illustrated with respect to one embodiment may be used in the same way or in a similar way in one or more other embodiments and/or in combination with, or instead of, the features of the other embodiments.

BRIEF DESCRIPTION OF THE DRAWINGS

FIG. 1 is an environmental view of an exemplary monolithic structure built with composite materials.

FIG. 2 is an isometric view of an exemplary ground anchor.

DETAILED DESCRIPTION OF EMBODIMENTS

Figure 3:
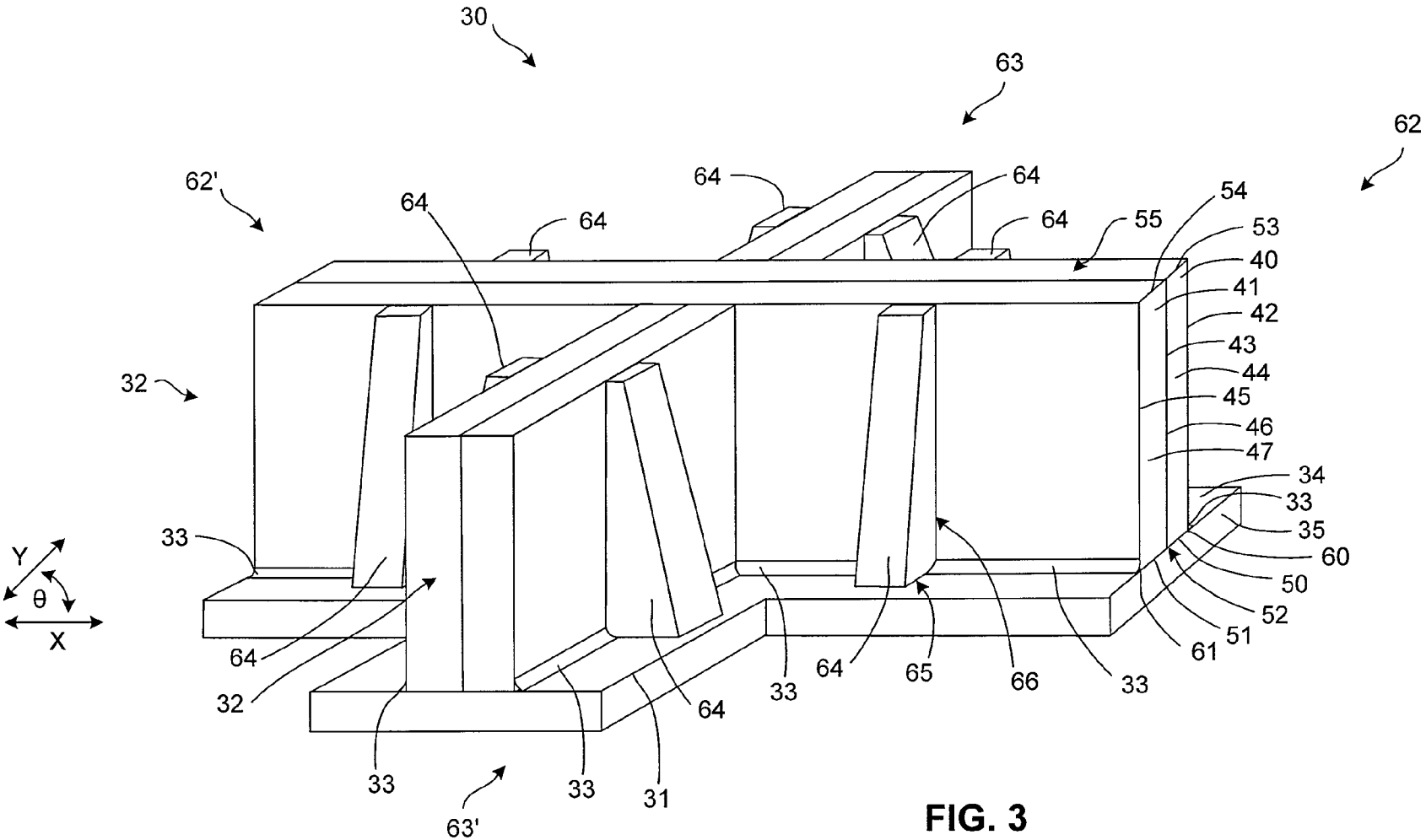
FIG. 3 is an isometric view of another exemplary ground anchor.

In the detailed description that follows, like components have been given the same reference numerals regardless of whether they are shown in different embodiments of the invention. To illustrate the present invention in a clear and concise manner, the drawings may not necessarily be to scale and certain features may be shown in somewhat schematic form. Certain terminology is used herein to describe the different embodiments of the invention. Such terminology is used for convenience when referring to the figures. For example, "upward," "downward," "above," "below," "left," or "right" merely describe directions in the configurations shown in the figures. Similarly, the terms "interior" and exterior" or "inner" and "outer" may be used for convenience to describe the orientation of the components in the figures. The components can be oriented in any direction and the terminology should therefore be interpreted to include such variations. The dimensions provided herein are exemplary in nature and are not intended to be limiting in scope. Furthermore, while described primarily with respect to house construction, it will be appreciated that the concepts described herein are equally applicable to the construction of any type of structure or building, such as warehouses, commercial buildings, factories, apartments, etc.

The structures described herein are built with composite materials, such as composite sandwich panels (also referred to as "sandwich panels" or "composite panels"). Sandwich panels may be formed from synthetic or natural materials and may provide a light-weight and potentially less expensive alternative to conventional raw materials, e.g., wood, concrete, metal, etc. If desired, natural materials may be used in the sandwich panels, as described in more detail below. The sandwich panels may be connected, bonded, adhered, secured, attached or joined together with a high-strength bonding material, such as epoxy or glue, and conventional fasteners, such as nails and screws, are not usually needed. The result is a strong and durable monolithic (e.g., single unit) structure, as is described further below.

Referring to FIG. 1, an exemplary monolithic structure 10, for example, a house, is built from a number of sandwich panels that are connected together with bonding material. The house 10 includes a front wall 10*f* formed from sandwich panels 11, 12, 13, 14, a side wall 10*s* formed from sandwich panels 15, 16, and a roof 17. The front wall 10*f* and side wall 10*s* are connected to one another at a corner 10*c* of the house 10. The house 10 also includes a number of other corners, e.g., corner 10*c*' and corner 10*c*". Although not shown in FIG. 1, it will be appreciated that the house 10 may include a number of other walls, e.g., another side wall, a rear wall, internal walls, etc. The house 10 also may include a number of openings 20, for example, for installing doors or windows.

A number of ground anchors 21, 22, 23 (also referred to as "building foundation members") are connected to the house 10 to anchor the house 10 to the ground. An exemplary ground anchor 22 includes a base member 24 and a support member 25 connected to the base member 24 with bonding material. The support member 25 is connected to a building element, e.g., the front wall 10*f* and/or the side wall 10*s*, with bonding material.

The ground anchors 21, 22, 23 are embedded or buried in the ground to anchor the house 10 to the ground. For example, as shown in FIG. 1, the ground anchor 22 is connected to the walls 10*f*, 10*s* at the corner 10*c* of the house 10. The other ground anchors 21, 23, are connected to different corners 10*c*', 10*c*" of the house 10, respectively, to provide additional anchoring support to the house 10.

Although shown as having three ground anchors 21, 22, 23, it will be appreciated that additional ground anchors may be disposed or connected to other portions of the house, e.g., a rear corner of the house (not shown in FIG. 1) or at other locations along the walls of the house 10. For example, the ground anchors may be connected along the walls between the corners, e.g., between corner 10*c* and corner 10*c*'. It also will be appreciated that a number of ground anchors may be connected to a middle portion or center portion of the house 10, rather than, or in addition to, the ground anchors at the walls. It also will be appreciated that the ground anchors may be prefabricated.

FIGS. 2 and 3 illustrate exemplary embodiments of a ground anchor 30. The ground anchor 30 includes a base member 31 and a support member 32 connected to the base member 31 with bonding material 33. The ground anchor 30 may be constructed from composite materials, such as the sandwich panels described below with respect to FIG. 4.

The base member 31 is a sandwich panel having an outer layer 34 and a core 35 of insulative material. The outer layer 34 covers a surface of the core 35 and is generally planar to facilitate connection of the base member 31 to the support member 32.

The support member 32 is connected to the outer layer 34 of the base member 31 with bonding material 33. The support member 32 includes two sandwich panels 40, 41. The sandwich panel 40 has two outer layers 42, 43 separated from one another by an insulative core 44. Sandwich panel 41 has two outer layers 45, 46 separated from one another by an insulative core 47.

Each of the sandwich panels 40, 41 have respective bottom edges 50, 51, which form a bottom surface 52 of the support member 32. The bottom surface 52 is generally planar to facilitate the engagement or connection of the support member 32 to the outer layer 34 of the base member 31. Each of the sandwich panels 40, 41 also has respective top edges 53, 54, which form a top surface 55 to the support member 32.

The outer layer 42 of sandwich panel 40 contacts the outer layer 34 of the base member 31 at the bottom edge 52 to form a corner 60 between the base member 31 and the support member 32. The outer layer 45 of sandwich panel 42 also contacts the outer layer 34 of the base member 31 at the bottom edge 52 to form another corner 61 between the base member 31 and the support member 32. The bonding material 33 is spread at the corners 60, 61 to connect the support member 32 to the outer layer 34 of the base member 31. The bonding material 33 may be spread or applied at the corners 60, 61 along the length of the ground anchor 30. Additionally or alternatively, bonding material may be spread or applied between the bottom surface 52 of the support member 32 and the outer layer 34 of the base member 31.

As shown in FIGS. 2 and 3, the base member 31 and the support member 32 are connected to one another at a 90-degree angle, e.g., the members are oriented in a generally perpendicular or normal relationship to one another. It will be appreciated, however, that the base member 31 and the support member 32 may be connected to one another at an angle other than 90-degrees, e.g., an angle that is greater than or less than 90-degrees.

The top surface 55 of the support member 32 is generally planar to facilitate the engagement or connection of the support member 32 to a building element, e.g., the walls 10*f*, 10*s* or a floor panel or base plate, as described with respect to FIGS. 5-7 below.

Referring specifically to FIG. 2, the ground anchor 30 includes a first portion 62 and a second portion 63. The first portion 62 extends in a first direction along an axis X. The second portion 63 extends in a second direction along an axis Y. The axes X and Y are at an angle θ (theta) relative to one another. For example, as shown in FIG. 2, the angle θ (theta) may be about 90-degrees such that the axes X, Y are perpendicular or normal to one another. The first portion 62 and second portion 63, therefore, may be at about a 90-degree angle relative to one another.

The first portion 62 and the second portion 63 may correspond to one or more building elements, e.g., walls 10*f*, 10*s*. For instance, the first portion 62 may correspond to the front wall 10*f* and the second portion 63 may correspond to the side wall 10*s* such that the ground anchor corresponds to the corner 10*c* of the house 10. Though shown as a 90-degree angle, it will be appreciated that the angle θ (theta) between the first portion 62 and the second portion 63 may correspond to an angle that is greater than 90-degrees (e.g., obtuse) or to an angle that is less than 90-degrees (e.g., acute). The angle θ (theta) also may be selected to align the first portion 62 and the second portion 63 to corresponding walls of the house 10.

In addition to the first portion 62 and second portion 63, the ground anchor 30 shown in FIG. 3 includes a third portion 62' extending along the X-axis, and a fourth portion 63' extending along the Y-axis. The first portion 62, second portion 63, third portion 62' and fourth portion 63' are, therefore, connected to one another in the general shape of a cross. The cross-shape ground anchor 30 of FIG. 3 may be connected to a middle portion or a center portion of the house 10 and may, for example, be connected to a base plate or floor panel, as shown in FIG. 7. The support member 32 of the cross-shape ground anchor 30 may be connected to one or more interior and/or exterior walls of the house 10.

Referring to FIGS. 2 and 3, it will be appreciated that the first portion 62, the second portion 63, the third portion 62' and fourth portion 63' may be formed at the same time, e.g., as a unitary element, or may be formed as separate elements that are connected to one another with bonding material. For example, the first portion 62 and the second portion 63 may be formed separately during the manufacturing process and connected with bonding material. The third portion 62' and fourth portion 63' also may be formed separately from one another and connected to one another with bonding material. Alternatively, the first portion 62 and third portion 62' may be a unitary or single component that is connected to the second portion 62 and/or the fourth portion 63', which may be formed separately from one another.

It also will be appreciated that the ground anchor 30 also may not extend in two directions, e.g., the X-axis and the Y-axis, but rather may extend in only one direction so that the ground anchor 30 is straight rather than angled. In such an embodiment, the ground anchor 30 may be placed along a wall (e.g., wall 10*s*) of the house 10 instead of at a corner (e.g., corner 10*c*) of the house 10.

Continuing to refer to FIGS. 2 and 3, the ground anchor 30 also may include a number of ribs 64, which are formed from sandwich panels. The ribs 64 have two outer layers separated from one another by a core. The ribs 64 provide support or reinforcement to the support member 32 and may, for example, buttress the support member 32 to increase the overall strength of the ground anchor to improve or to increase the load-bearing potential of the anchor. The ribs 64 may be evenly spaced along edges of the ground anchor, as shown in FIG. 2, or may be staggered, as may be desired.

Each rib 64 has a bottom surface 65 that is connected to the outer layer 34 of the base member 31 with bonding material. The bonding material may be spread or applied between the outer layer 34 and the bottom surface 65. Each rib 64 also has a side surface 66 that is connected to an outer layer of the support member 32, e.g., outer layer 42 or outer layer 45, with bonding material that may be spread or applied between the side surface 66 and the outer layers 42, 45.

Figure 4:
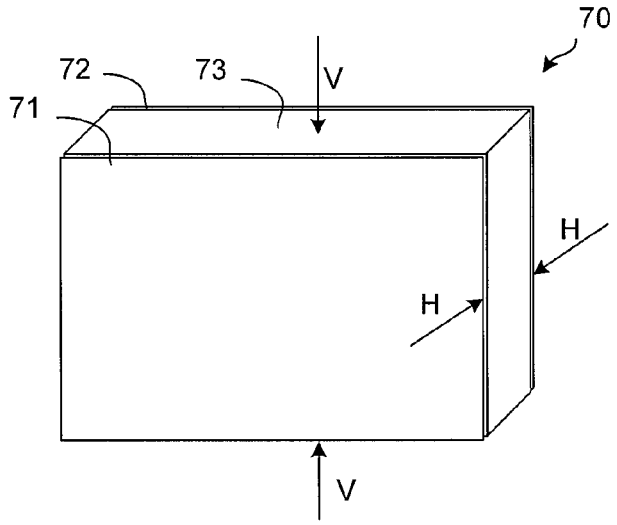
FIG. 4 is an isometric view of an exemplary sandwich panel.

An exemplary sandwich panel is shown in FIG. 4. The sandwich panel 70 includes two outer layers 71, 72 separated by a core 73. The outer layers 71, 72 are bonded or adhered to the core 73 with bonding material.

The core 73 of the exemplary sandwich panel 70 may be formed from a light-weight, insulative material, for example, polyurethane, expanded polystyrene, polystyrene hard foam, Styrofoam® material, phenol foam, a natural foam, for example, foams made from cellulose materials, such as a cellulosic corn-based foam, or a combination of several different materials. Other exemplary core materials include honeycomb that can be made of polypropylene, non-flammable impregnated paper or other composite materials. It will be appreciated that these materials thermally insulate the interior of the structure and also reduce the sound or noise transmitted through the panels. The core may be any desired thickness and may be, for example, about 30 mm (millimeters)-100 mm (millimeters) thick, however, it will be appreciated that the core can be thinner than 30 mm (millimeters) or thicker than 100 mm (millimeters) as may be desired. In one embodiment, the core is about 60 mm (millimeters) thick.

The outer layers 71, 72 of the sandwich panel 70, are made from a composite material that includes a matrix material and a filler or reinforcement material. Exemplary matrix materials include a resin or mixture of resins, e.g., epoxy resin, polyester resin, vinyl ester resin, natural (or non oil-based) resin or phenolic resin, etc. Exemplary filler or reinforcement materials include fiberglass, glass fabric, carbon fiber, or aramid fiber, etc. Other filler or reinforcement materials include, for example, one or more natural fibers, such as, jute, coco, hemp, or elephant grass, balsa wood, or bamboo.

The outer layers 71, 72 (also referred to as laminate) may be relatively thin with respect to the panel core 73. The outer layers 71, 72 may be several millimeters thick and may, be, for example between about 1 mm (millimeter)-12 mm (millimeters) thick, however, it will be appreciated that the outer layers can be thinner than 1 mm (millimeter) or thicker than 12 mm (millimeters) as may be desired. In one embodiment, the outer layers are about 1-3 mm (millimeter) thick.

It will be appreciated that the outer layers 71, 72 may be made thicker by layering several layers of reinforcement material on top of one another. The thickness of the reinforcement material also may be varied to obtain thicker outer layers 71, 72 with a single layer of reinforcement material. Further, different reinforcement materials may be thicker than others and may be selected based upon the desired thickness of the outer layers.

The outer layers 71, 72 are adhered to the core 73 with the matrix materials, such as a resin mixture. Once cured, the outer layers 71, 72 of the sandwich panel 70 are firmly adhered to both sides of the panel core 73, forming a rigid building element. It will be appreciated that the resin mixture also may include additional agents, such as, for example, flame retardants, mold suppressants, curing agents, hardeners, etc. Coatings may be applied to the outer layers 71, 72, such as, for example, finish coats, paint, ultra-violet (UV) protectants, water protectants, etc.

The core 73 may provide good thermal insulation properties and structural properties. The outer layers 71, 72 may add to those properties of the core and also may protect the core 73 from damage. The outer layers 71, 72 also provide rigidity and support to the sandwich panel.

The sandwich panels may be any shape. In one embodiment, the sandwich panels are rectangular in shape and may be several meters, or more, in height and width. The sandwich panels also may be other shapes and sizes. The combination of the core 73 and outer layers 71, 72 create sandwich panels with high ultimate strength, which is the maximum stress the panels can withstand, and high tensile strength, which is the maximum amount of tensile stress that the panels can withstand before failure. The compressive strength of the panels is such that the panels may be used as both load bearing and non-load bearing walls. In one embodiment, the panels have a load capacity of at least 50 tons per square meter in the vertical direction (indicated by arrows V in FIG. 4) and 2 tons per square meter in the horizontal direction (indicated by arrows H in FIG. 4). The sandwich panels may have other strength characteristics as will be appreciated in the art.

Internal stiffeners may be integrated into the panel core 73 to increase the overall stiffness of the sandwich panel 70. In one embodiment, the stiffeners are made from materials having the same thermal expansion properties as the materials used to construct the panel, such that the stiffeners expand and contract with the rest of the panel when the panel is heated or cooled.

The stiffeners may be made from the same material used to construct the outer layers of the panel. The stiffeners may be made from composite materials and may be placed perpendicular to the top and bottom of the panels and spaced, for example, at distances of 15 cm (centimeters), 25 cm, 50 cm, or 100 cm. Alternatively, the stiffeners may be placed at different angles, such as a 45-degree angle with respect to the top and bottom of the panel, or at another angle, as may be desired.

Figure 5:
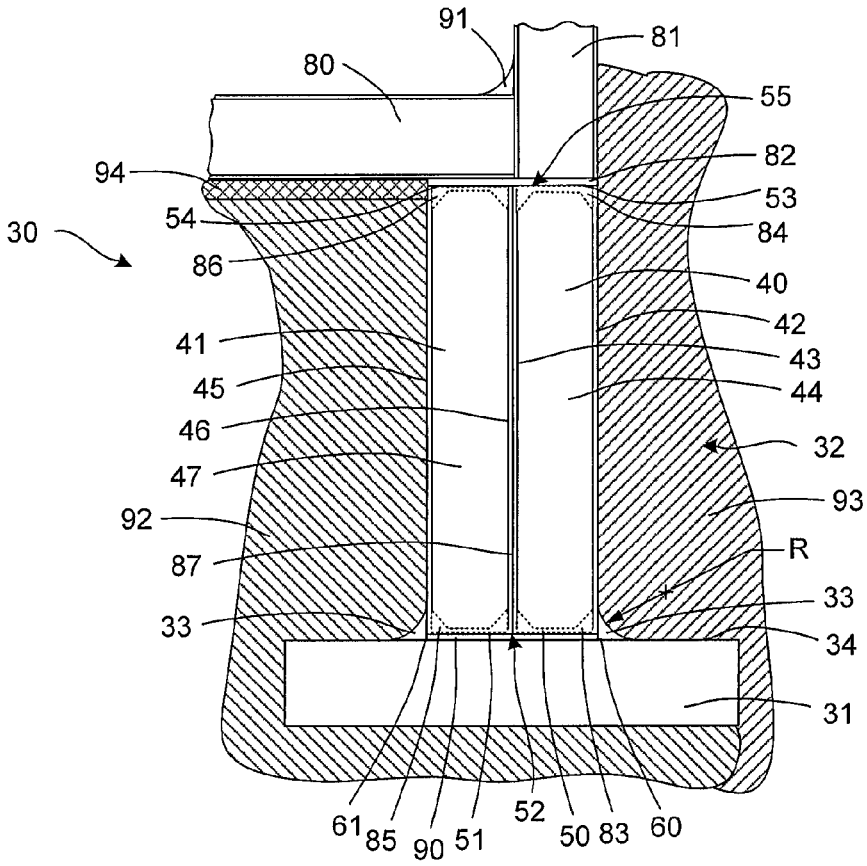
FIG. 5 is a schematic sectional view of an embodiment of a building foundation member buried in the ground.
Figure 7:
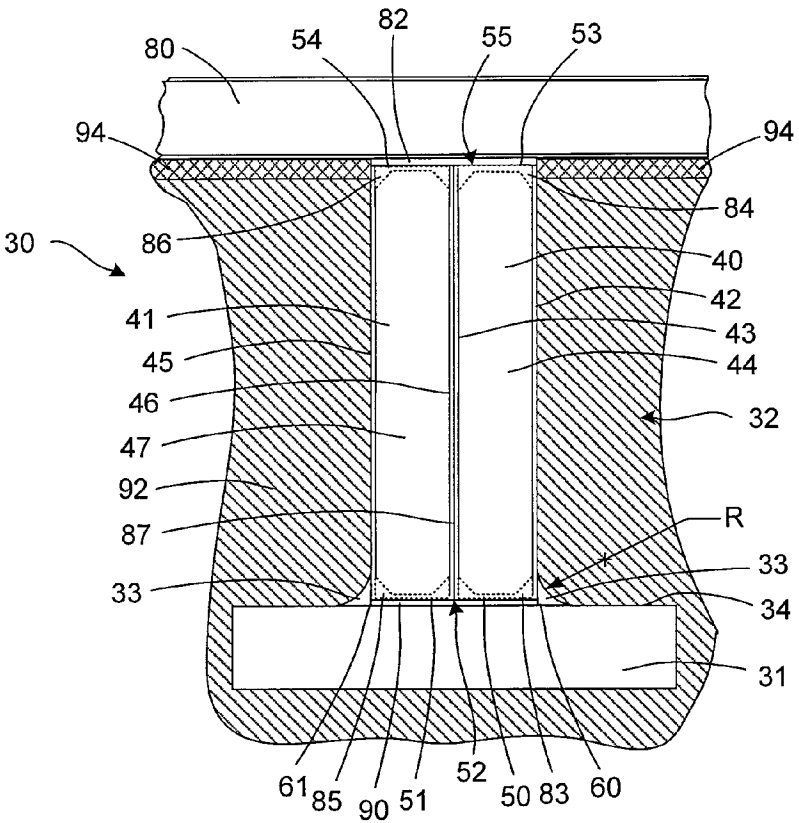
FIG. 7 is a schematic sectional view of an embodiment of a building foundation member buried in the ground.
Figure 6:
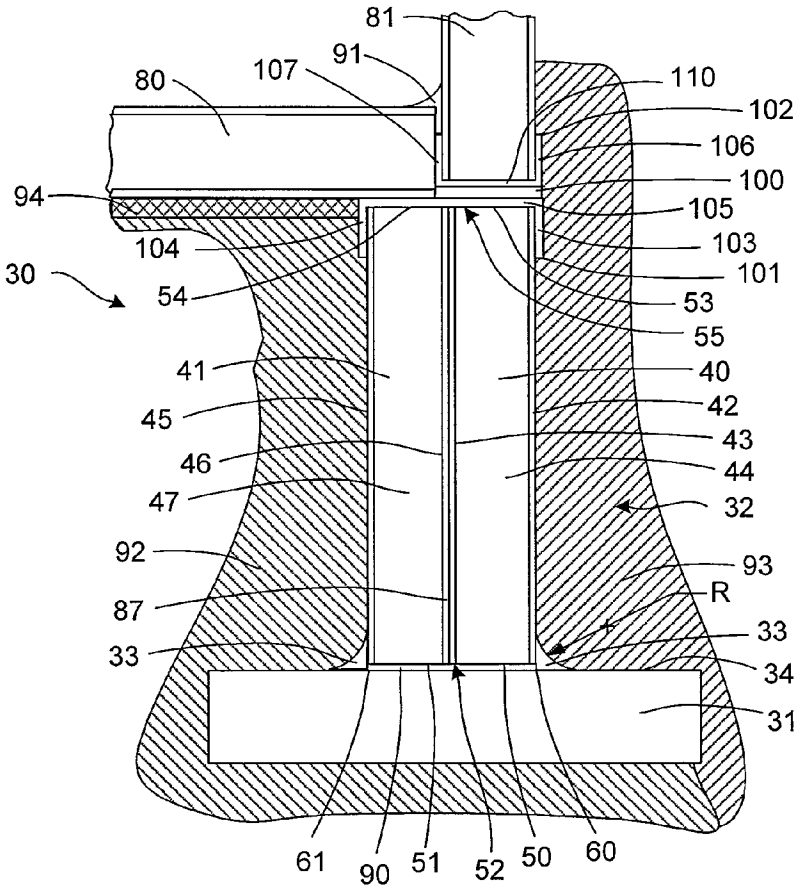
FIG. 6 is a schematic sectional view of an embodiment of a building foundation member buried in the ground.

FIGS. 5-7, illustrate exemplary embodiments of a building foundation member that is embedded or buried in the ground and connected to a portion of the house 10. In each of the embodiments, a number of sandwich panels are connected together to form the ground anchor 30. In the embodiment of FIG. 5 and FIG. 7, the edges of the sandwich panels are closed or sealed with a bonding material to form a rigid edge. In the embodiment of FIG. 6, the sandwich panels are connected to with U-shape or U-profile brackets.

Referring to FIG. 5, the ground anchor 30 is shown with the base member 31 and the support member 32 connected to one another by bonding material 33. The support member 32 is connected to one or more building elements 80, 81 with bonding material 82.

The support member 32 includes two sandwich panels 40, 41. As described above, sandwich panel 40 has two outer layers 42, 43 separated by a core 44, and the second sandwich panel 41 has two outer layers 45, 46 separated by a core 47. The sandwich panels 40, 41 each have respective bottom edges 50, 51 that form the bottom surface 52 of the support member 32. The sandwich panels 40, 41 also have respective top edges 53, 54, which form the top surface 55 of the support member 32.

The bottom edge 50 of sandwich panel 40 is closed or sealed with bonding material by removing a portion 83 of the core 44 and replacing it with bonding material. The bonding material solidifies to form a solid or rigid bottom edge 50. The top edge 53 may be prepared in the same manner by removing a portion 84 from the core 44 and replacing it with bonding material. The bonding material solidifies to form a solid or rigid top edge 53. The second sandwich panel 41 is prepared in a similar manner by removing a portion 85 from the bottom edge 51 and replacing it with bonding material, and by removing portion 86 from the top edge 54 and replacing it with bonding material.

The sandwich panels 40, 41 may be connected to one another by bonding material 87 spread or applied between the outer layer 43 of the first sandwich panel 40 and the outer layer 46 of the second sandwich panel 41. When the sandwich panels 40, 41 are connected together, the bottom edges 50, 51 form the bottom surface 52 of the support member 32. The bottom surface 52 is generally planar to facilitate connection of the support member 32 to the base member 31. The top edges 53, 54 form the top surface 55 of the support member. The top surface 55 is generally planar to facilitate connection of the support member 32 to the one or more construction elements 80, 81. While shown as being constructed from two sandwich panels 40, 41, it will be appreciated that the support member 32 may be constructed from a single sandwich panel, which may have a width that is the same as or that is greater than the width of the individual sandwich panels 40, 41. It will be appreciated that the support member 32 may include one sandwich panel or a number of sandwich panels, for example, three or more sandwich panels connected to one another with bonding material.

The support member 32 is connected to the outer layer 34 of the base member 31 with bonding material 33 spread along the length of the ground anchor 30. The bonding material 33 may be spread at the corners 60, 61 formed by the outer layers 42, 45 of the sandwich panels 40, 41 and the outer layer 34 of the base member 31. The bonding material 33 may be formed or molded to form a rounded corner, which may facilitate the transfer or distribution of forces between the outer layers 42, 45 of the sandwich panels 40, 41 in the support member 32 and the outer layer 34 of the base member 31, and generally not through the panel cores, which may not be able to withstand or support the same magnitude of forces as the outer layers.

As shown in FIG. 5, the bonding material 33 is shaped into a rounded corner having a radius R. The length of the radius R may be based upon the thicknesses of the outer layers, e.g., outer layers 42, 45, according to a desired ratio. The desired ratio of the radius R to the thickness of the outer layers 42, 45 may be about seven to one (7:1), or more, e.g., 8:1 or an even larger ratio. For instance if the outer layers 42, 45 are about 2 mm (millimeters) thick, the radius would be at least about 14 mm (millimeters), and may be thicker, if desired, or adjusted based upon a desired strength or other factor. In another example, the outer layers 42, 45 may be 3 mm (millimeters) thick, the radius would be at least about 21 mm (millimeters) or more.

Additional bonding material 90 may be applied between the bottom surface 52 of the support member 32 and the outer layer 34 of the base member 31 to increase or strengthen the bond between the base member 31 and the support member 32, as may be desired.

The support member 32 is connected to one or more building elements, such as, for example, a floor panel 80 or a wall 81, or another building element such as a base plate, which also may be made from one or more sandwich panels. The building elements 80, 81 are connected to the outer layer 55 of the support member 32 with bonding material 82. The bonding material 82 may be spread or applied at the top surface 55 and along the length of the support member 32. Additional bonding material 91 may be applied or spread at the junction between the floor panel 80 and the wall 81 to rigidly bond or secure the floor panel 80 to the wall 81. As described above with respect to the bonding material 33 between the base member 31 and the support member 32, the bonding material 91 may be molded or formed into a rounded corner to distribute or to spread forces to the outer layers of the floor panel 80 and wall 81.

As described in more detail below, the ground anchor 30 is installed by placing the ground anchor 30 in a hole and burying it with filler material 92, 93. The filler material 92, 93 may be compacted or firmed around the anchor 30. Additionally, a layer 94 of material, such as sand, may be spread over the compacted ground to provide a planar or flat surface for the ground plate or floor panel 80.

Referring now to FIG. 6, another embodiment of the ground anchor 30 connected to building elements 80, 81 is shown. In the embodiment of FIG. 6, the support member 32 is connected to the building elements 80, 81 by bonding material 100 connecting two U-profile brackets 101, 102 together, rather than by removing a portion of the sandwich cores and replacing the portions with bonding material to form rigid edges. The various parts of FIG. 6 generally correspond to the parts described with respect to FIG. 5.

As shown in FIG. 6, the U-profile bracket 101 has two side walls 103, 104 and a bottom wall 105. The U-profile bracket 102 has two side walls 106, 107 and a bottom wall 110. The side walls and the bottom wall of each U-profile bracket 101, 102 are connected to form the general shape of a "U."

The U-profile brackets 101, 102 may be formed from composite materials, for example, the composite materials used to construct the outer layers 71, 72 of the sandwich panel 70, as described above with respect to FIG. 4. The side walls 103, 104 and bottom wall 105 of the U-profile bracket 101 may be relatively thin with respect to the support member 32, and may, for example be the same thickness as the outer layers 42, 45 of the sandwich panels 40, 41, or may be about two or three times thicker than the outer layers 42, 45. For instance, the walls 103, 104, 105 may be several millimeters thick and may, be, for example, between about 1-12 mm (millimeters) thick; however, it will be appreciated that the walls can be thinner than 1 mm (millimeter) or thicker than 12 mm (millimeters), as may be desired.

The U-profile bracket 101 is connected to the support member 32 at the top surface 55 of the support member 32 with bonding material, which may be located between the top edge 55 of the support member 32 and the bottom wall 105 of the U-profile bracket 101 and/or between the side walls 103, 104 of the U-profile bracket 101 and the outer layers 42, 45 of the sandwich panels 40, 41.

The U-profile bracket 102 is connected to the wall 81 by bonding material, which may be located between the bottom wall 110 of the U-profile bracket 102 and the wall 81 and/or between the side walls 106, 107 of the U-profile bracket 102 and the outer layers of the wall 81.

The building elements 80, 81 are connected to the support member 32 by bonding material 100. The bonding material 100 may be spread or applied between the bottom wall 105 of U-profile bracket 101 and the bottom wall 110 of the U-profile bracket 102. The bonding material 100 also may be applied between the floor panel 80 and the bottom wall 105 of the U-profile bracket 101. The floor panel 80 also may be connected to the wall 81 by bonding material 91 as described above with respect to FIG. 5. The bonding material 110 may be spread or be applied between the floor panel 80 and the side wall 107 of the U-profile bracket 102. The bonding material 91, 100 forms a rigid connection between the ground anchor 30 and the building elements 80, 81 to form a building foundation member that anchors the house 10 to the ground.

It will be appreciated that while FIG. 6 depicts two separate U-profile brackets 105, 110 connecting the support member 32 to the building elements 80, 81, the U-profile brackets 105, 110 may be combined to form a single bracket, connected to the support member 32 and the building elements 80, 81 by bonding material.

FIG. 7 illustrates another embodiment of a ground anchor 30 buried in the ground. The different components of FIG. 7 correspond to those described above with respect to FIG. 5, and for brevity, the description will not be repeated. In the embodiment of FIG. 7, the ground anchor 30 is connected at a center portion or middle portion of the house 10 with bonding material 82 between the top surface 55 of the support member 32. The ground anchor 30 may be connected to the floor panel 80 or base plate, which may be located at a middle portion or center portion of the house 10.

In the embodiments of FIGS. 5-7, the support member 32 is shown connected to the outer layer 34 of the base member 31 at about the midpoint or center of the outer layer 34, such that an approximately even or equal area of the outer layer 34 extends on both sides of the support member 32. The ground anchor 30, therefore, has a cross-section that is generally in the form of an inverted "T." When buried, generally equal portions of filling material cover the outer layer 34 on both sides of the support member 32. The equal distribution of filling material on the base member 31 tends to fix the ground anchor 30 in the ground. Once buried, the ground anchor 30 is relatively stationary and, therefore, is less likely to move or to be moved without excavating or digging the ground around ground anchor 30 to uncover the base member 31.

While the ground anchor in the illustrated embodiment is in the shape of an inverted "T," it will be appreciated that other configurations are possible. For example, the support member 32 may be in the connected at any location on the outer layer 34 and may, be, for example connected such that the cross-section of the ground anchor is in the form of an "L," e.g., such that a greater area of the outer layer 34 is on one side of the support member 32 than the other side of the support member 32.

In the illustrated embodiments, the base member 31 and the support member 32 are perpendicular to one another. It will be appreciated, however, that other configurations are possible. For example, the support member 32 may be at an angle relative to the base member 31, e.g., by forming or cutting the bottom edge 52 of the support member 32 at an angle prior to connecting the support member 32 to the base member 31. When the angle edge of the support member 31 is connected to the generally planar outer layer 34, the cross-section of the ground anchor 30 may take the form of an inverted "7." Such variations and/or alterations to the ground anchor will be evident to one of skill in the art, and the ground anchor may be modified as desired, for example, as called for by the engineering or design plan or by factors such as environmental conditions, strength of materials, etc.

Continuing to refer to FIGS. 5-7, the bonding material connecting the support member 32 to the building elements 80, 81 (e.g., bonding material 82 and bonding material 100) may be a layer of bonding material that is about 1-5 mm (millimeters) thick, or more. It will be appreciated that thicker or thinner amounts bonding material may be selected as desired. The bonding material used to connect the sandwich panels together may be more flexible than the sandwich panels, and may, be, for example four or five times more flexible than the panels. The flexibility of the bonding material, therefore, reduces the likelihood than the panels of the monolithic structure will break or split apart while rigidly bonding the ground anchor 30 to the house 10.

Continuing to refer to FIGS. 5-7, the ground anchor 30 is installed by excavating a portion of the ground at the construction site to form a hole into which the ground anchor 30 may be set. Prior to placing the ground anchor 30 in the hole, the material (e.g., dirt, sand or gravel) at the bottom of the hole is compacted, for example, to create a solid foundation onto which the ground anchor 30 is placed, for example, to reduce the likelihood that the building or building foundation will sink. The compacted ground also may provide a flat surface onto which the ground anchor can be set, for example so that the house 10 is level. The bottom of the hole may be filled with a filler material (e.g., dirt, gravel, sand, etc.) which can be spread to form a level surface for the ground anchor 30. The filler material also may facilitate or provide drainage around the ground anchor 30 and the house 10, and may include a filter layer of gravel.

The ground anchor is placed into the hole and the hole is filled with additional filler material, for example, soil, gravel or another suitable material. The filler material may be compacted on both sides of the base member 31, as shown in FIG. 7. As shown in FIGS. 5 and 6, the filler material 92 underneath the house 10 (e.g., the left side of FIG. 5 or FIG. 6) may be compacted more than the filler material 93 that is not underneath the house (e.g., the right side of FIG. 5 or FIG. 6). The compacted ground may provide additional support to maintain the ground anchor in place when the hole is filled, and may allow the building to withstand greater loads or forces.

The filler material 92, 93 is used to bury the ground anchor 30 in the ground and cover the base member 31. The weight of the filler material on the anchor 30 makes it difficult to remove the anchor 30 from the ground. Due to the low weight of a building made from sandwich panels, the increased force required to remove the anchor 30 from the ground provides increased rigidity and stability to the building, for example, to withstand environmental conditions, such as wind, earthquakes, or other disasters, etc.

A layer 94 of material is spread over the compacted ground 92. The layer 94 of material is leveled to the top surface 55 of the support member 32. The layer 94 provides a surface on which the floor panel or ground plate of the building may be set. In one embodiment, the layer 94 is about 2 cm (centimeters)-4 cm (centimeters) thick. The layer 94 may be thicker or thinner based on the material or as may be desired.

The layer 94 may be a fine material that generally does not damage the composite materials used to build the house 10 or ground anchor 30. The layer 94 and the filler materials 92, 93, may be made from a granular material, for example, gravel or sand. The granular material may have a grain size of about 0 mm (millimeters)-4 mm (millimeters). It will be appreciated that the layer 94 and filler material 82, 93 may be formed from different materials or a combination of materials, such as, for example, sand, gravel, dirt, etc. In one embodiment, the sand may have a grain size of about 0.2 mm (millimeters), however, larger or smaller grain sizes may be used, as may be desired.

The depth that the ground anchor 30 is embedded or buried into the ground may be based upon the height of the ground anchor 30 and may be calculated or determined by a designer, engineer, architect, construction foreman, or another person responsible for constructing or designing the building. For example, the depth of the anchor 30 may be determined by calculating the static and dynamic loads that the building and ground anchors should be able to support or withstand and the properties of the plot on which the building is to be constructed. The depth of the ground anchor 30 also may be determined based upon the properties of the ground, such as the density of the ground at the construction site, and other factors, such as frost should be taken into consideration. In one embodiment, the ground anchor 30 is placed at a depth of about 50 cm (centimeters)-100 cm (centimeters). It will be appreciated that the ground anchor 30 may be placed deeper into the ground based upon a static calculation by the designer or engineer, or as may be required or desired.

Although the invention has been shown and described with respect to a certain preferred embodiment or embodiments, it is obvious that equivalent alterations and modifications will occur to others skilled in the art upon the reading and understanding of this specification and the annexed drawings.

What is claimed is:

1. A ground anchor comprising:

a base member having a core and an outer layer connected to the core;

a support member including at least one sandwich panel having two outer layers separated from one another by a core, the support member having a top surface and a bottom surface, each of the two outer layers having an end portion at the bottom surface of the support member and the core having an end that is recessed from the end portions of the outer layers thereby to provide a space between the end portions of the outer layers at the bottom surface of the support member; and bonding material that is spread or applied to at least one of the outer layer of the base member, the bottom surface of the support member, or at least one of the two outer layers of the support member to substantially fill the space between the end portions of the outer layers at the bottom surface of the support member and to adhere the bottom surface of the support member to the outer layer of the base member without an intervening connecting element;

wherein the outer layer of the base member faces the bottom surface of the support member and the support member is connected to the base member with the bonding material.

2. The ground anchor of claim 1, further comprising bonding material connecting the top surface of the support member to a building element.

3. The ground anchor of claim 2, wherein a connection between the support member and the building element is further comprised of a U-profile bracket.

4. The ground anchor of claim 1, wherein the base member and the support member extend in a first direction along a first axis and extend in a second direction along a second axis.

5. The ground anchor of claim 4, wherein the first direction corresponds to a portion of a first wall of a building, and the second direction corresponds to a portion of a second wall of the building.

6. The ground anchor of claim 5, wherein the support member comprises at least one additional sandwich panel having two outer layers separated from one another by a core and wherein the first sandwich panel and the additional sandwich panel are connected to one another.

7. The ground anchor of claim 6, further comprising at least one rib having a bottom surface connected to the outer layer of the base member and a side surface connected to one of the outer layers of one of the sandwich panels of the support member.

8. The ground anchor of claim 7, wherein the base member is generally horizontal and the support member is generally vertical.

9. The ground anchor of claim 1, wherein the top surface of the support member includes bonding material at an edge of the sandwich panel where a portion of the core has been removed.

10. The ground anchor of claim 1, wherein the support member comprises at least one additional sandwich panel having two outer layers separated from one another by a core and wherein the first sandwich panel and the additional sandwich panel are connected to one another.

11. The ground anchor of claim 1, wherein the base member is a composite sandwich panel.

12. A building foundation member usable to anchor a building to the ground, the building foundation member comprising, a ground anchor including a base member having a core and an outer layer connected to the core;

a support member including at least one sandwich panel having a core and two outer layers separated from one another by the core, and further including a top surface and a bottom surface, each of the two outer layers having an end portion at the bottom surface of the support member and the core having an end that is recessed from the end portions of the outer layers thereby to provide a space between the end portions of the outer layers at the bottom surface of the support member, or each of the two outer layers having an end portion at the top surface of the support member and the core having an end that is recessed from the end portions of the outer layers thereby to provide a space between the end portions of the outer layers at the top surface of the support member; and a building element comprised of a sandwich panel having a core and an outer layer connected to the core;

wherein to substantially fill the space between the end portions of the outer layers at the top surface of the support member and to adhere the building element to the top surface of the support member with bonding material that is spread or applied to at least one of the outer layer of the building element, the top surface of the support member, or at least one of the two outer layers of the support member without an intervening connecting element or to substantially fill the space between the end portions of the outer layers at the bottom surface of the support member and to adhere the outer layer of the base member to the bottom surface of the support member by bonding material that is spread or applied to at least one of the outer layer of the base member, the bottom surface of the support member, or at least one of the two outer layers of the support member without an intervening connecting element;

wherein the outer layer of the building element faces the top surface of the support member;

wherein the outer layer of the base member faces the bottom surface of the support member; and wherein the ground anchor is at least partially submerged in the ground.

13. The building foundation member of claim 12, wherein the base member and the support member extend in a first direction along a first axis and at a second direction along a second axis.

14. The building foundation member of claim 13, wherein the first direction corresponds to a portion of a first wall of a building, and the second direction corresponds to a portion of a second wall of the building.

15. The building foundation member of claim 14, wherein the ground anchor further comprises a rib connected to the outer layer of the base member and one of the outer layers of the sandwich panel of the support member.

16. The building foundation member of claim 15, wherein the base member and the support member are generally perpendicular to one another.

17. The building foundation member of claim 15, wherein the ground anchor is connected to a corner of the building.

18. The building foundation member of claim 15, further comprising a number of ground anchors connected to different corners of the building.

19. The foundation member of claim 12, wherein the building element is at least one of a floor panel or a wall.

20. The foundation member of claim 19, wherein the support member and the building element are connected by a U-profile bracket.

21. The foundation member of claim 19, wherein the top surface of the support member further comprises bonding material at an edge of the sandwich panel where a portion of the core has been removed.

22. A method of anchoring a building to the ground with a ground anchor comprising:

excavating a portion of the ground to form a hole;

placing the ground anchor into the hole, wherein the ground anchor is comprised of a generally horizontal sandwich panel including an outer layer and a generally vertical support sandwich panel including two outer layers, a top surface, and a bottom surface, each of the two outer layers having an end portion at the bottom surface of the generally vertical support sandwich panel and the core having an end that is recessed from the end portions of the outer layers thereby to provide a space between the end portions of the outer layers at the bottom surface of the support member;

wherein said placing comprises placing the generally horizontal sandwich panel in the hole with the outer layer of the generally horizontal sandwich panel to face the generally vertical support sandwich panel; and attaching the generally vertical support sandwich panel to the generally horizontal sandwich panel with a bonding material to substantially fill the space between the end portions of the outer layers at the bottom surface of the support member and to adhere by spreading or applying bonding material to at least one of the outer layer of the generally horizontal sandwich panel, at least one of the two outer layers of the generally vertical support sandwich panel, or the bottom surface of the generally vertical support sandwich panel without an intervening connecting element;

filling the hole with a filler material;

compacting a portion of the filler material in the hole; and connecting further the generally vertical support sandwich panel to a building element of the building by spreading or applying bonding material between the generally vertical support sandwich panel and the building element.

23. The method of claim 22, wherein the connecting further step further comprises connecting the ground anchor to at least one of a wall, a floor panel or a corner of the building.

24. The method of claim 22, wherein the connecting further step further comprises connecting the generally vertical support sandwich panel to the building element by spreading or applying bonding material to at least one of the top surface of the generally vertical support sandwich panel, a portion of the building element facing the top surface of the generally vertical support sandwich panel, or at least one of the two outer layers of the generally vertical support sandwich panel between the generally vertical support sandwich panel and the building element.

* * * * *